US007310857B2

(12) United States Patent
Kim

(10) Patent No.: US 7,310,857 B2
(45) **Date of Patent: *Dec. 25, 2007**

(54) RETAIL DISPLAY STRAP FOR SECURING A TIE TO A SHIRT

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 175 days.

This patent is subject to a terminal disclaimer.

(21) Appl. No.: 11/166,913

(22) Filed: Jun. 23, 2005

(65) Prior Publication Data

US 2006/0010560 A1 Jan. 19, 2006

Related U.S. Application Data

(63) Continuation-in-part of application No. 10/809,672, filed on Mar. 24, 2004, now Pat. No. 6,978,518, which is a continuation-in-part of application No. 10/250,158, filed on Jun. 9, 2003, now Pat. No. 6,901,636.

(51) Int. Cl.
*B65D 63/00* (2006.01)

(52) U.S. Cl. ..... 24/17 A; 24/16 PB; 24/17 R; 24/30.5 P

(58) Field of Classification Search ..... 24/17 AP
See application file for complete search history.

(56) References Cited

U.S. PATENT DOCUMENTS 520,145 A * 5/1894 Newman ..... 24/17 A
914,614 A * 3/1909 Strom ..... 24/17 A
1,266,275 A * 5/1918 Kelly ..... 24/17 A
1,719,618 A * 7/1929 Novick ..... 24/17 R
1,829,613 A * 10/1931 Sato ..... 402/15
1,986,649 A * 1/1935 Steele ..... 24/17 R
2,004,098 A * 6/1935 Andrews ..... 24/17 R
2,081,242 A * 5/1937 Long ..... 223/83
2,156,583 A * 5/1939 Chaplin ..... 24/17 R
2,204,004 A * 6/1940 Steele ..... 223/83
2,286,181 A * 6/1942 Steele ..... 24/17 R
2,321,147 A * 6/1943 Kennedy ..... 223/71
3,543,977 A * 12/1970 Lockridge ..... 224/222
3,662,434 A * 5/1972 Clayton ..... 24/30.5 P
3,835,505 A * 9/1974 Shewbridge ..... 24/16 R
3,942,192 A * 3/1976 Harris ..... 24/66.3

(Continued)

*Primary Examiner*—Robert J. Sandy
(74) *Attorney, Agent, or Firm*—Darby & Darby P.C.

(57) ABSTRACT

A system and method for securing a tie to a folded shirt. The system includes a folded shirt having buttons down the front thereof; a tie; and an elongated strap defining first and second loops wherein the folded shirt is disposed in the first loop and the tie is disposed in the second loop. The method includes the steps of providing a strap having a first side and an opposite second side extending between first and second ends; attaching the tie to the neck area of the folded shirt; positioning the tie along the folded shirt; wrapping the strap around the folded shirt; attaching the first end of the strap to the second side at a first location proximal to the second end and attaching the second end of the strap to the first side at a second location proximal to the first end to thereby define a main loop containing the folded shirt and a second loop suitable for containing a portion of the tie; and inserting the tie into the second loop.

8 Claims, 7 Drawing Sheets

U.S. PATENT DOCUMENTS 3,997,943 A * 12/1976 Jones et al. ..... 24/30.5 P
4,213,548 A * 7/1980 Wood ..... 224/168
4,466,159 A * 8/1984 Burrage ..... 24/16 PB
4,817,837 A * 4/1989 Grover ..... 224/250
4,942,644 A * 7/1990 Rowley ..... 24/16 PB
5,086,543 A * 2/1992 Mitchell ..... 24/16 PB
5,170,507 A * 12/1992 Langford et al. ..... 2/150
5,214,874 A * 6/1993 Faulkner ..... 43/25.2
5,289,619 A * 3/1994 Pileggi ..... 24/306
5,416,926 A * 5/1995 Koy ..... 2/153
5,983,461 A * 11/1999 Chen ..... 24/66.9
6,216,275 B1 * 4/2001 Lee ..... 2/144
6,510,590 B1 * 1/2003 Lin ..... 24/66.9

* cited by examiner

RETAIL DISPLAY STRAP FOR SECURING A TIE TO A SHIRT

This application is a continuation-in-part of U.S. Ser. No. 10/809,672 filed Mar. 24, 2004, which is a continuation-in-part of U.S. Ser. No. 10/250,158 filed Jun. 9, 2003, which is hereby incorporated by reference in its entirety.

BACKGROUND OF THE INVENTION

Retailers are discovering that shirt and tie combinations packaged together better meet the needs of a certain class of shoppers. When displaying and selling dress shirts in combination with ties, retailers assist their clients with a fashion choice that can be time consuming. Furthermore, when suitably coordinated, a shirt and a tie combination can make a more attractive display item for sale than if displayed individually.

Unfortunately, some consumers tend to remove and replace ties from their previously associated shirt, and thus create additional costs and difficulties to the retailer. Among other problems created, the individual components are not separately priced. Thus, retailers would benefit from a way to package shirt and tie combinations so that the consumer is discouraged from removing ties from these combinations. Retailers would further benefit from a device for packaging such combinations that can securely attach to these articles in a non-destructive way. The present invention satisfies these and other needs.

SUMMARY OF THE INVENTION

The present invention overcomes the disadvantages of the prior art, providing a system and method for securing a tie to a folded shirt. In accordance with the present invention, retailers can securely attach a tie to a shirt, thereby providing a shirt and tie combination which discourages consumers from removing a tie from the combination. The shirt and tie combination can be placed on display for sale in retail outlets and stores.

In accordance with another aspect of the invention the method includes the step of providing a strap having a first side and an opposite second side, first and second ends, and a buttonhole. The tie is attached to the neck area of the folded shirt and positioned along the buttons of the shirt. The strap is wrapped around the folded shirt and the buttonhole secured to one of the buttons. The method also includes the step of attaching the first end of the strap to the second side and the second end of the strap to the first side to thereby define a main loop containing the folded shirt and a second loop suitable for containing a portion of the tie, and then inserting the tie into the second loop.

Optionally, the first and second ends are attached to the first and second sides, respectively, using glue, staples, buttons, thread or a heat seal. Also optionally, the strap is transparent, can include indicia thereon, is composed of plastic, fabric or rubber, or possesses more than one of these features.

In another aspect, the present invention concerns a folded shirt and tie combination, comprising a folded shirt having buttons down the front thereof. The combination includes a tie and an elongated strap having a first end and a second end, wherein the first and second ends are attached to one another so as to define a first loop configured for the placement of the folded shirt therein and a second loop configured for the placement of a tie therethrough.

These and further aspects, features and advantages of the present invention will become more apparent from the following description when taken in connection with the accompanying drawings which show, for purposes of illustration only, several embodiments of the present invention.

BRIEF DESCRIPTION OF THE DRAWINGS

The present invention is illustrated by way of example and not by way of limitation in the figures of the accompanying drawings in which like references indicate similar elements. It should be noted that the references to "an" or "one" embodiment of this disclosure are not necessarily to the same embodiment, and such references mean at least one.

DETAILED DESCRIPTION OF EXEMPLARY EMBODIMENTS

Figure 1:
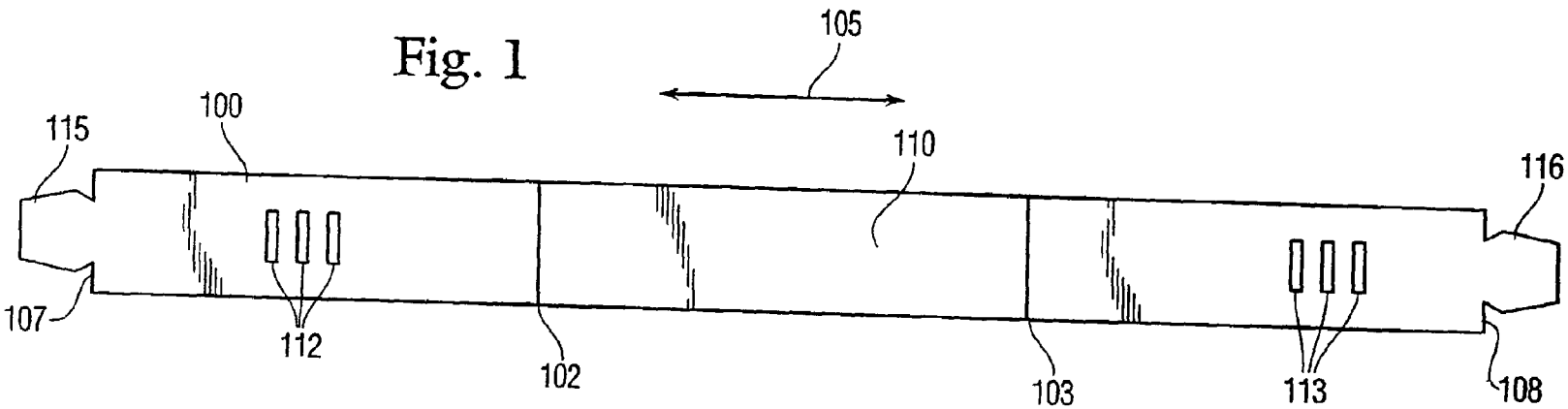
FIG. 1 is a depiction of a first embodiment of the present invention in an unfolded state.
Figure 2:
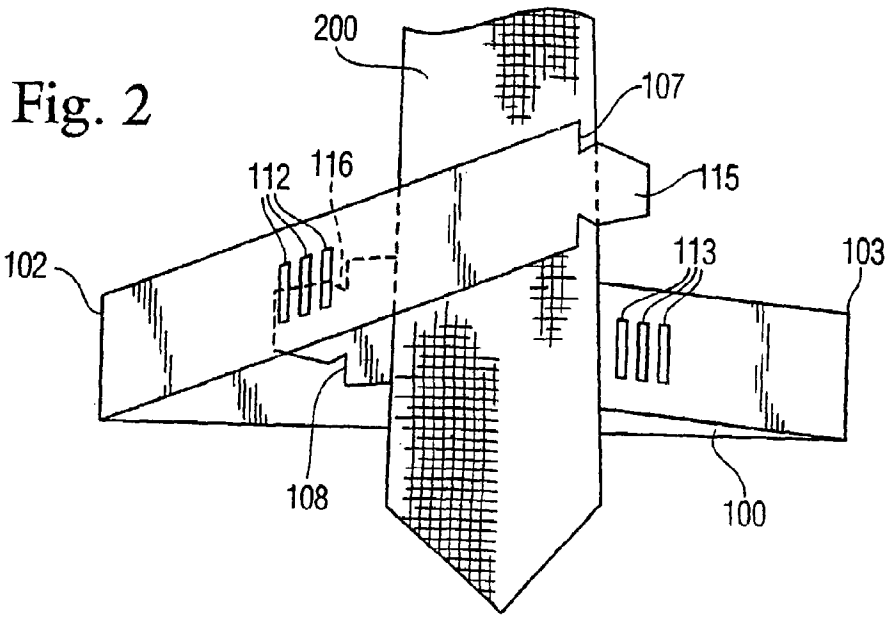
FIG. 2 is a depiction of the first embodiment in a folded state.

The main component of the present invention is the body 100, shown in FIG. 1 in an unfolded state and in FIG. 2 in a folded state. The body 100 folds along scorelines 102 and 103. The scorelines are indentations that are either created as part of the manufacture of the body or are the result of the folding of the body.

The body 100 extends in horizontal direction, marked by arrow 105, between ends 107 and 108. The body can be composed of a variety of materials. In a preferred embodiment, plastic is used. Also, in a preferred embodiment, the body is manufactured from a transparent material in order to reveal a shirt and a tie beneath it. Furthermore, in a preferred embodiment, the body 100 includes indicia, for example, placed on the portion 110 between the scorelines 102 and 103. Indicia may include trade names and/or describe the merchandise with which the present invention is to be used.

The body 100 also includes a set of first lock-slots 112 and a set of second lock-slots 113. Multiple lock-slots help accommodate shirts of different dimensions. A first lock-tab 115 is placed next to the first end 107 and a second lock-tab 116 is placed next to the second end 108. While each of the two sets of lock-slots, 112 and 113, respectively, are shown comprising multiple slots, it is within the scope of the present invention that each set of lock-slots is replaced by a single slot.

The present invention is used in conjunction with a folded shirt (300 in FIG. 3) and a tie (200 in FIG. 2) attached thereto. When folded along the scorelines 102 and 103, the body 100 can be made to wrap around the shirt, as shown in FIG. 2. In a preferred embodiment, the tie is folded to span portions of the top and bottom surfaces of the shirt. The body 100 is placed in a position so that it intersects the tie at least once (and preferably twice—on the top and the bottom of the folded shirt).

Figure 3:
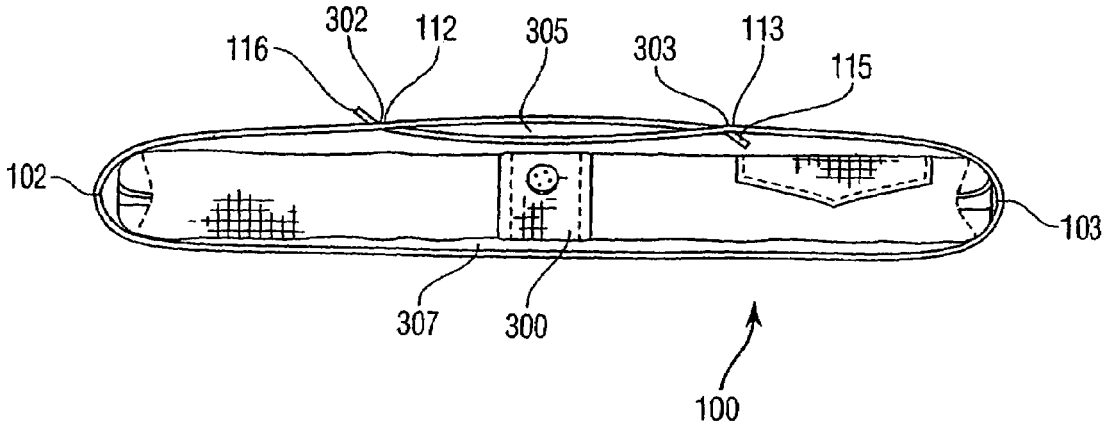
FIG. 3 is an end view of the first embodiment in a folded state.

When body 100 is folded, as shown in FIG. 2, the second lock-tab 116 is inserted in one of the first slots 112 and the first lock-tab 115 is inserted in one of the second slots 113. FIG. 3 shows a side view of the body 100 wrapped around a folded shirt 300. There it can be seen that when lock-tab 116 is inserted into lock-slot 112 a lock-joint 302 is formed. Similarly, when lock-tab 115 is inserted into lock-slot 113, lock-joint 303 is formed. The ends 107, 108 remain fixed to define the channel 305 because the lock tabs 115 and 116 preferably include at least a portion that is larger than the lock slots. When these insertions are made, the channel 305 defined between the lock-joints 302 and 303 and a portions of the body 100 is suitable for the insertion of a tie therein. In a preferred embodiment the channel is so formed that it provides frictional resistance to the tie when placed therein. Thus, once a tie is placed-within the channel one must exert a force on the tie in order to pull it out.

If the tie 200 is placed so that it intersects the body 100 twice, then the one end of the tie is placed in the space between the body 100 and the folded shirt 307.

Figure 4:
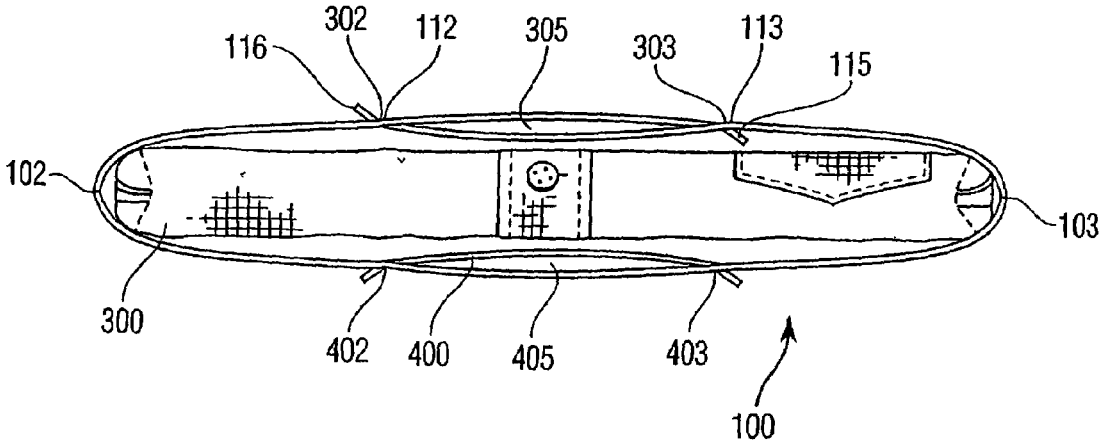
FIG. 4 is an end view of a variation of the first embodiment.

FIG. 4 depicts an alternative arrangement of the present invention. There, a strip 400 is added to the folded body in a position corresponding to the underside of folded shirt 300. The strip 405 is attached to the body 100 by joints 402 and 403. These joints may be created by the above described lock-tab and lock-joint method or by any other method, such as, for example, the use of glue, tape, staples, heat-seal, etc. In FIG. 4, the strip 400 is placed between the body 100 and the folded shirt 300. It may however be placed on the other side of the body 100, so that the body 100 is between the strip 400 and the shirt 300. The strip 400 helps form a second channel 405, which is also suitable for the placement of a tie therein. Thus, in cases where the tie is folded in such a way as to intersect the body 100 twice, the tie can be placed within the first channel 305 and within the second channel 405. Alternatively, channel 405 can be used to hold a second tie (not shown).

Figure 5A:
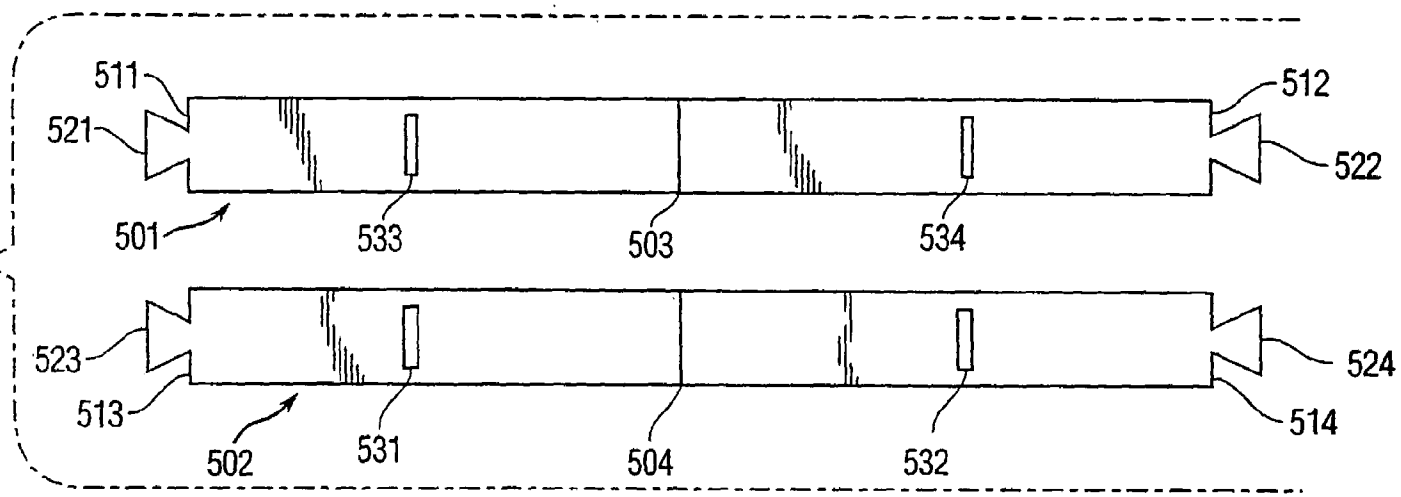
FIG. 5A is a depiction of a second embodiment of the invention in the unfolded state.
Figure 5B:
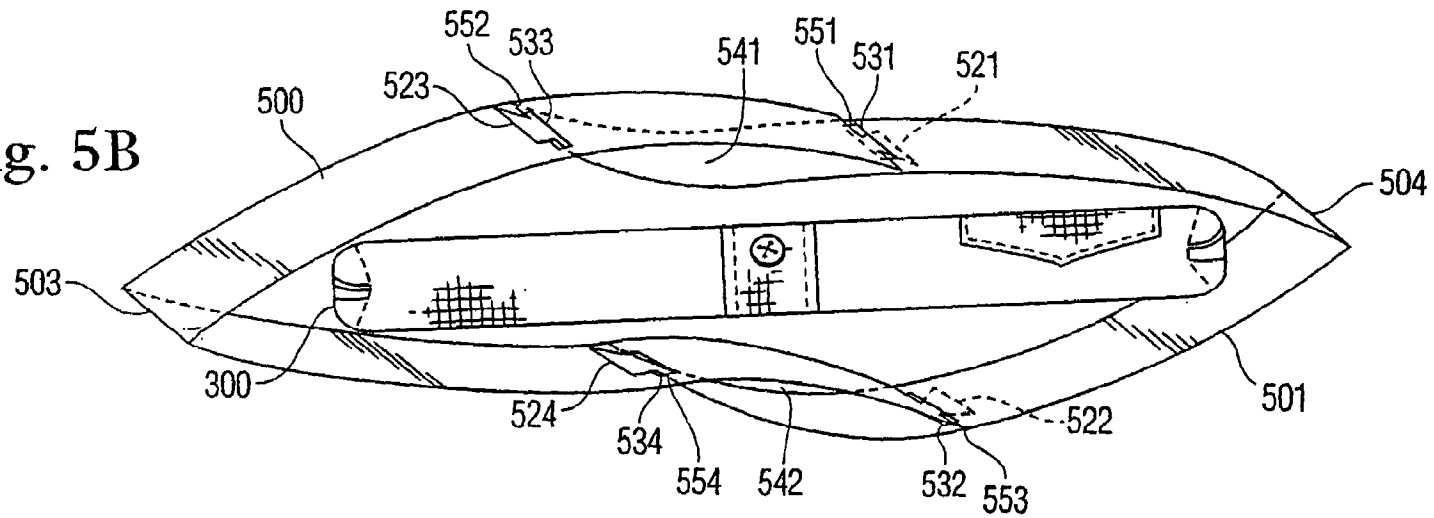
FIG. 5B is a depiction of the second embodiment of the invention in a folded state.

A second embodiment of the invention is depicted in FIGS. 5A and 5B. Referring to FIG. 5A, two elongated bodies 501 and 502 are shown. Each elongated body comprises a single scoreline 503 and 504 which is perpendicular to the direction the body extends in. The first elongated body 501 extends between a first end 511 and a second end 512 and the second elongated body 502 extends between a third end 513 and a fourth end 514. There are first, second, third and fourth lock-tabs 521, 522, 523 and 524 placed adjacent to the first, second, third and fourth ends 511, 512, 513 and 514, respectively. Each elongated body comprises two lock-slots (531-534). The lock-slots of each elongated body are on opposing sides of its scoreline. First and second lock-slots 531 and 532 are positioned on the second elongated body 502. The first lock-slot 531 is proximate to third end 513, and the second lock-slot 532 is proximate to the fourth end 514. Third and fourth lock-slots 533 and 534 are positioned on the first elongated body 500. The third lock-slot 533 is proximate to first end 511, and the fourth lock-slot 534 is proximate to the second end 512.

The two elongated bodies are folded along their respective scorelines and wrapped around a folded shirt 300 as shown in FIG. 5B. The first lock-tab 521 engages the first lock-slot 531 and the third lock-tab 523 engages the third lock-slot 533 to form a first pair of lock-joints 551 and 552, respectively. The second lock-tab 522 engages the second lock-slot 532 and the fourth lock-tab 524 engages the fourth lock-slot 534 to form a second pair of lock-joints 553 and 554, respectively. After the engagements are made and the lock-joints are formed, first and second channels 541 and 542 are formed between the lock-joints and the two elongated bodies. These channels are suitable for the placement of a tie or ties therein. In a preferred embodiment a single tie is placed within one of the channels, folded along one of the sides of a folded shirt and placed within the other channel.

Figure 6:
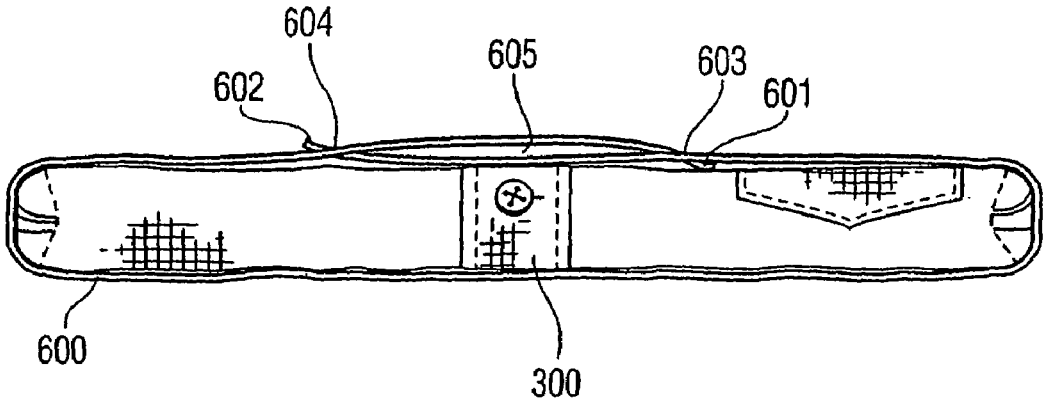
FIG. 6 is a depiction of a third embodiment of the present invention.

A third embodiment of the present invention is depicted in FIG. 6 where the elongated body 600 is composed of fabric. The fabric elongated body 600 has first and second ends 601 and 603. The elongated body 600 is wrapped around the folded shirt 300 in a similar fashion to the way the elongated body 100 of the first embodiment is wrapped. However, instead of using lock-tabs and lock-slots, the ends 601, and 602 are attached to binding points 603 and 604, the binding points being positioned on the elongated body. Thus, the elongated body 600 forms a main loop, or a fabric strap, around the folded shirt 300. A channel 605 sized for the placement of a tie therein is formed between the binding points and portions of the strap.

Figure 7:
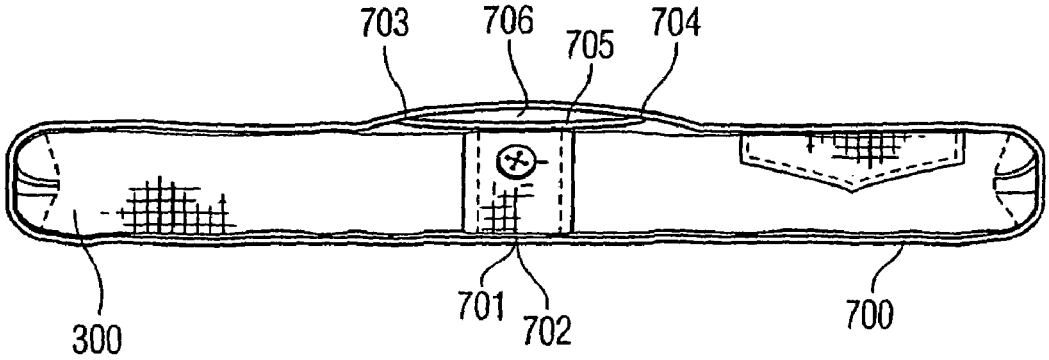
FIG. 7 is a depiction of a fourth embodiment of the present invention.

A fourth embodiment of the present invention is depicted in FIG. 7. In this embodiment a fabric elongated body 700 is used. The elongated body is made to form a main loop by attaching its ends 701 and 702. The main loop is suitable for the placement of a folded shirt 300 therein. An additional wall 705, composed, preferably of the same material as the elongated body 700, is attached to the elongated body 700 at two attachment points 703 and 704. A channel 706 is formed between the elongated body 700, the wall 705 and the attachment points 703 and 704. The channel 706 is suitable for the placement of a tie therein.

Regarding the third and forth embodiments discussed above, fabric elongated bodies 600 and 700 need not be restricted solely to fabric and can be readily composed of plastic, rubber, metal, or any other material useful for surrounding a folded shirt and tie combination.

In use, a tie is secured to a folded shirt without requiring that the shirt and tie combination be enclosed in a bag, box or other cover. Such enclosure is seen as detrimental to the display characteristics of the shirt and tie combination, because customers often want to feel the fabric of the shirt and/or tie before they buy the combination.

The tie is attached to the neck area of a folded shirt. There are several known methods for effecting such attachment. Pins, or a plastic or paper device may be used for this purpose. The tie is then positioned along the buttons of the folded shirt. A strapping device as described herein is wrapped around the shirt. The tie is inserted into the strapping device. The wrapping and inserting steps can optionally be performed simultaneously. This can be achieved, for example, when using some of the strapping devices described above. More specifically, referring to FIG. 2, the tie 200 can be placed within the strapping device 100 (i.e. the elongated body), while the action of wrapping the folded shirt with the strapping device 100 is ongoing, that is, while the lock-tab 116 is being placed in a lock-slot 112 and the lock-tab 115 is about to be placed in a lock-slot 113.

Figure 8:
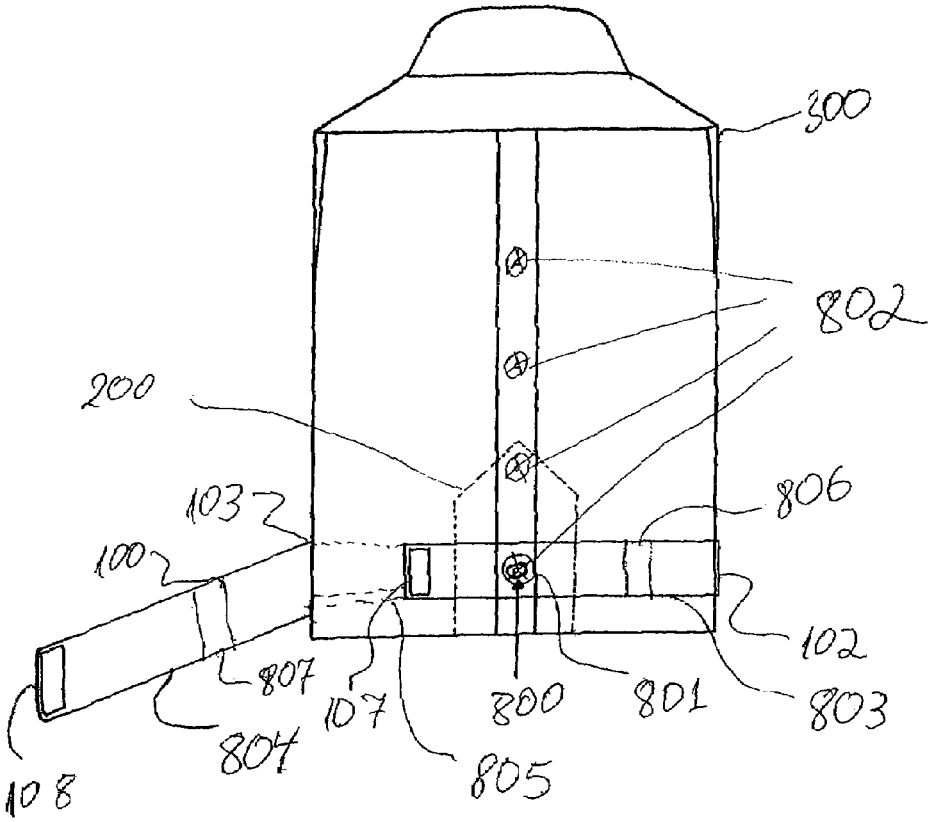
FIG. 8 is a depiction of a fifth embodiment of the present invention.

A further embodiment of the present invention is shown in FIG. 8. FIG. 8 shows the back side of a folded shirt 300. The shirt includes a row of buttons 802. A tie 200, is attached to the folded shirt. The tie is folded along the bottom of the folded shirt so that a portion of it is disposed along the back of the folded shirt as shown in FIG. 8. A strap is placed around the folded shirt. The strap comprises an elongated body 100 having first and second scorelines, as shown in FIGS. 1 and 2 and described above. The elongated body is foldable along the scorelines.

A first side portion 803 of the elongated body 100 is defined between the first scoreline 102, and the first end 107. A buttonhole 800 is placed through the first side portion of body 100. The buttonhole is sized to accommodate one of the buttons of the row of buttons 802. A second side portion 804 is defined between the second scoreline 103 and the second end 108. A central portion 805 is defined between the first and second scorelines 102 and 103. In FIG. 8, the central portion 805 is hidden, as it extends across the front side of the folded shirt. The central portion has a length sufficient to accommodate one dimension of the folded shirt, i.e., the transverse dimension relative to the row of buttons 802. Thus, in FIG. 8, the central portion accommodates the width of the folded shirt.

The combined length of the first and second side portions is greater than that of the central portion. Therefore, when the elongated body is folded along the scorelines, the first and second side portions overlap. It is preferred but not required that the first and second side portions are of equal length. After folding the elongated body, the first end 107 is attached to the second side portion 804 at a position 807 which is displaced from the second end 108. Similarly, the second end 108 is attached to the first side portion 803 at a position 806 which is displaced from the first end 107. The attachments may be made in various manners, including for example, the use of glue, stapling, and hot stamping. Optionally, areas of the body in proximity to the first and second ends 107 and 108 and the first and second attachment positions 806 and 807 are roughened to facilitate the application of glue thereon. When the attachments are made, a channel is formed between the overlapping portions of the first and second side portions. The channel is suitable for the placement of a tie therein.

In use, an elongated body, such as the one shown in FIG. 8, is provided. A tie is disposed on a folded shirt. One portion of the tie is secured proximate to the collar and a second portion depends downwardly along the row of buttons. The elongated body is wrapped around the folded shirt. The first side portion can be placed under the tie. The buttonhole 800 is preferably secured to a button 801, which belongs to the row of buttons 802. The second side portion 804 can be placed over the tie. The first end 107 is attached to the elongated body at a first position 807 which is displaced from the second end. The second end 108 is attached to the elongated body at second a position 806 which is displaced from the first end. Thus, the tie may be placed between the first and second side portions and secured between the first and second positions before or after the first and second ends are attached or after one of these ends has been attached. The first and second attachment positions can be spaced so as to permit a tie to be seated flat between them.

Figure 9:
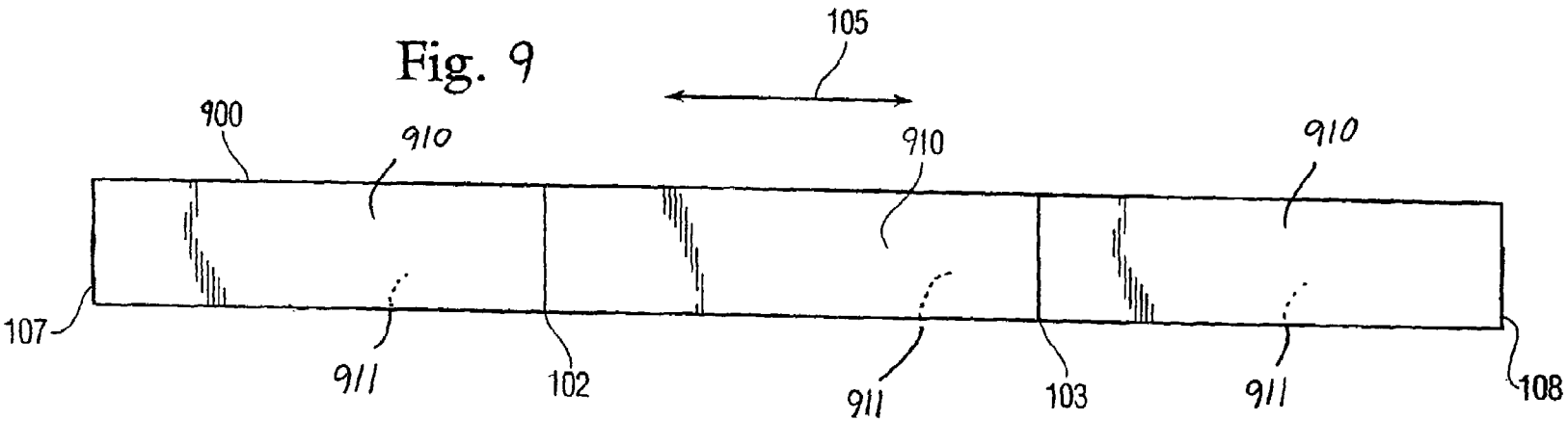
FIG. 9 is a depiction of a sixth embodiment of the present invention in an unfolded state.

Referring to FIG. 9, a sixth embodiment of the present invention is shown. Body 900 is shown in an unfolded state in FIG. 9 and in a folded state in FIG. 10. Body 900 has a first side 910 and an opposite second side 911 and first and second ends, 107 and 108, respectively. The body 900 is flexible and folds along scorelines 102 and 103. The scorelines 102 and 103 are indentations that are either created as part of the manufacture of the body 900 or are the result of the folding of the body. Additional scorelines can be created on body 900 without departing from the spirit of the present invention. Likewise, body 900 can be designed without any scorelines.

Body 900 extends in horizontal direction, marked by arrow 105, between first and second ends 107 and 108. The body can be composed of a variety of materials, e.g., plastic, rubber, fabric and metal. In a preferred embodiment, body 900 is composed of a transparent plastic such as to reveal a shirt and a tie beneath it. Furthermore, body 900 preferably includes descriptive indicia, for example, placed on the portion 910 between the scorelines 102 and 103. Such indicia may include trade names and/or describe the merchandise with which the present invention is to be used.

Figure 10:
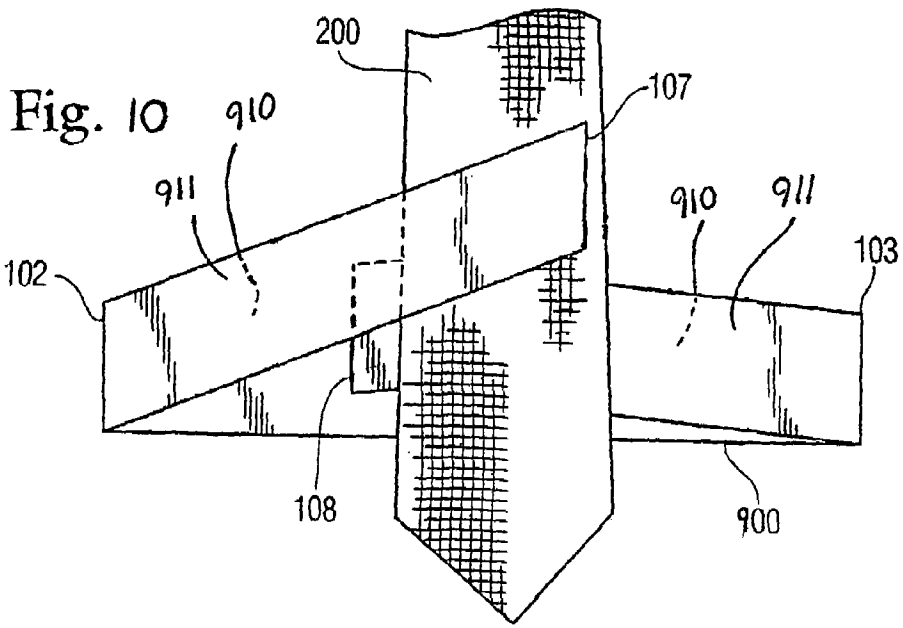
FIG. 10 is a depiction of the first embodiment in a folded state.
Figure 11:
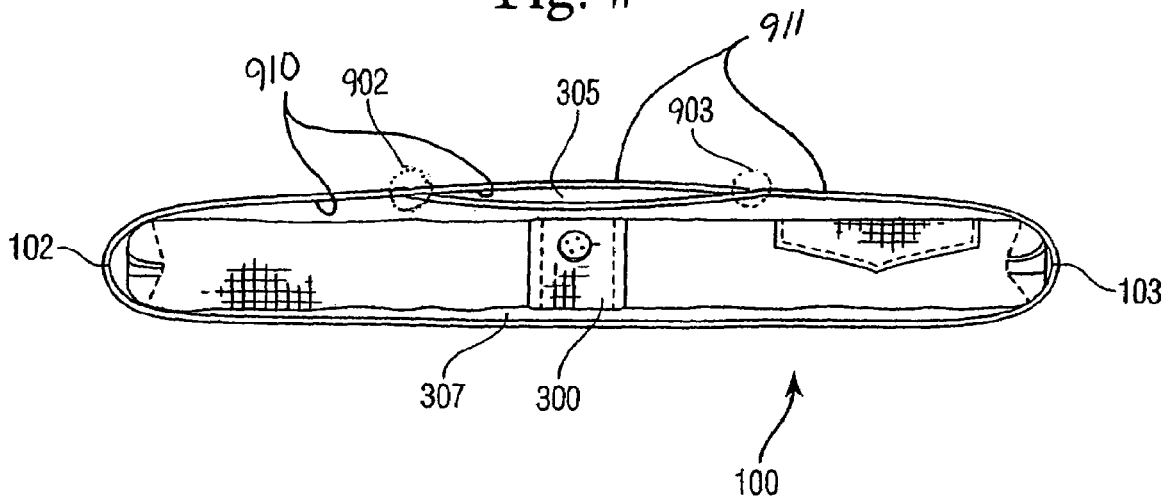
FIG. 11 is an end view of the first embodiment in a folded state.

The present invention is used in conjunction with a folded shirt (300 in FIG. 11) and a tie (200 in FIG. 10). When folded at the scorelines 102 and 103, the body 900 can be made to wrap around the shirt 300, as shown in FIG. 11. In a preferred embodiment, the tie is folded to span portions of the top and bottom surfaces of the shirt. The body 900 is placed in a position so that it intersects the tie at least once (and preferably twice—on the top and the bottom surfaces of the folded shirt).

When body 900 is folded, as shown in FIGS. 10 and 11, the first end 107 is attached to the second side 911 and the second end 108 is attached to the first side 910. Any suitable attachment means can be used to attach the ends 107 and 108 to the respective sides 911 and 910, i.e., glue, staples, buttons, mating slots, heat seal, etc. FIG. 11 shows a side view of the body 900 wrapped around a folded shirt 300. There it can be seen that when first end 107 is attached to second side 911 a binding point 903 is formed. Similarly, when second side 108 is attached to first side 910 a binding point 903 is formed. Ends 107, 108 remain fixed at their respective binding points to define the channel 305. The channel 305 defined between the binding points 902 and 903 and portions of body 900 is sized to be suitable for the insertion of a tie therein. Optionally, channel 305 is formed such that it provides frictional resistance to the tie when placed therein (e.g., via waves in the body 900). Thus, once a tie is placed within the channel one must exert a force on the tie in order to pull it out.

One method for securing a tie to a folded shirt using body 900 is described as follows. Tie 200 is attached to the neck area of folded shirt 300 and positioned along the buttons of the shirt. As illustrated in FIG. 11, body 900 is wrapped around shirt 300, first end 107 is attached to second end 911, and second end 108 is attached to first end 910. A main loop or first cavity 307 containing folded shirt 300 and a second loop or cavity 305 suitable for containing a portion of tie 200 has thereby been defined. Lastly, tie 200 can be inserted into the second loop. As discussed above, binding points 902 and 903 are formed when the first and second ends, 107 and 108 respectively, are attached to their respective sides. Binding points 902 and 903 in correlation with body 900 define the first and second cavities 307 and 305 respectively. As is apparent to one of skill in the art, the order of the above steps can be interchanged without departing from the primary objective. For example, and in accordance with alternative arrangements, body 900 can be wrapped around shirt 300 first. Next, the first end 107 can be attached to second end 911 and second end 108 attached to first end 910. Afterward, tie 200 can be attached to the neck area of folded shirt 300, positioned along the buttons of the shirt, and inserted within into the second loop. Again, alternatively, the tie 200 can be positioned on the shirt 300 over the body 900 after attaching the first end 107 to the second end 911 and before completing the cavity 305, that is, before attaching the second end 108 to the first end 910.

Expedients of the present invention described in one embodiment are not to be limited to that embodiment and can be readily combined with any of the other described embodiments. Furthermore, any feature of one embodiment, not expressly described in connection with an alterative arrangement or embodiment, can be combined with that arrangement or embodiment to derive benefit therefrom. For example, a buttonhole sized to accommodate a button of the folded shirt, which has been described in one embodiment of the invention, can be combined with any of the other embodiments for the added benefit of securing the body to the shirt via one of its buttons. Additionally, a body comprising a set of first and second lock-slots and tabs can be replaced by a body of any other embodiment, i.e., a body without lock-slots and tabs attachable by any other described attachment means.

While the invention has been described with reference to several embodiments thereof, the invention is more broadly defined and limited only by the recitations in the claims appended hereto and their legal equivalents.

I claim:

1. A strap for use with a shirt and tie combination, comprising:

an elongated body extending in a first direction and having a first end and a second end;

a first attachment point along the elongated body proximate the second end, the first end being attached to a first binding point;

a second attachment point along the elongated body proximate the first end, the second end being attached to a second binding point; and first and second scorelines spaced from one another and extending generally perpendicular to the first direction, wherein a main loop sized for the placement of the folded shirt is defined by the attachment of at least one of the first and second ends;

wherein a channel sized for the placement of the tie therein is defined between the first and second attachment points, and wherein the elongated body is foldable at the first and second scorelines.

2. The strap of claim 1, wherein the channel is further defined by a first portion of the body that extends from the first end to the second attachment point and by a second portion of the body that extends from the second end to the first attachment point.

3. The strap of claim 1, wherein the main loop comprises a portion of the body extending from the first end to the first attachment point.

4. The strap of claim 1, wherein the strap further comprises a first side and an opposite second side, and wherein the first and second ends are attached to the first and second sides, respectively.

5. The strap of claim 1, wherein the strap is transparent.

6. The strap of claim 1 further comprising:

a space between the first and second scorelines, the space being sized to accommodate a dimension of a folded shirt, wherein a portion of the strap between the first scoreline and the first end and a portion of the strap between the second scoreline and the second end are sufficiently long to allow the first and second ends to attach to the second and first binding points, respectively, when the elongated body is folded at the first and second scorelines.

7. The strap of claim 6, wherein the first scoreline is more proximate to the first end than the second scoreline is proximate to the first end.

8. A strap for use with a shirt and tie combination, comprising:

an elongated body extending in a first direction and having a first end and a second end;

a first attachment point along the elongated body proximate the second end, the first end being attached to a first binding point;

a second attachment point along the elongated body proximate the first end, the second end being attached to a second binding point; and first and second scorelines spaced from one another and extending generally perpendicular to the first direction, wherein a main loop sized for the placement of the folded shirt is defined by the attachment of at least one of the first and second ends; and wherein a channel sized for the placement of the tie therein is defined between the first and second attachment points, wherein the elongated body is foldable at the first and second scorelines, and wherein a portion of the strap between the first scoreline and the first end and a portion of the strap between the second scoreline and the second end are sufficiently long to allow the first and second ends to attach to the second and first binding points, respectively, when the elongated body is folded at the first and second scorelines.

* * * * *